US007647937B2

(12) United States Patent
Gordon

(10) Patent No.: US 7,647,937 B2
(45) Date of Patent: Jan. 19, 2010

(54) ASSISTIVE WALKING DEVICE WITH MULTIPLE SUPPORT SPHERES

(76) Inventor: Ellis David Gordon, 2801 Quebec Street NW., Apt. 243, Washington, DC (US) 20008

( * ) Notice: Subject to any disclaimer, the term of this patent is extended or adjusted under 35 U.S.C. 154(b) by 239 days.

(21) Appl. No.: 11/653,881

(22) Filed: Jan. 17, 2007

(65) Prior Publication Data

US 2007/0175503 A1 Aug. 2, 2007

Related U.S. Application Data

(60) Provisional application No. 60/763,112, filed on Jan. 28, 2006.

(51) Int. Cl.
*A45B 9/04* (2006.01)

(52) U.S. Cl. ..... 135/65; 135/85; 135/70

(58) Field of Classification Search ..... 135/65–66, 135/69–70, 77–78, 82, 84–86; 248/614–616; D3/15–17
See application file for complete search history.

(56) References Cited

U.S. PATENT DOCUMENTS 994,194 A 6/1911 Pratt
1,022,858 A * 4/1912 Markus ..... 248/188.9
1,406,453 A 2/1922 Fanning
1,438,883 A 12/1922 Youngren
4,027,687 A * 6/1977 McGowan ..... 135/66
4,062,372 A 12/1977 Slusher
4,085,763 A 4/1978 Thomas
4,630,626 A 12/1986 Urban
D290,186 S * 6/1987 Meunchen ..... D3/9
4,958,651 A 9/1990 Najm
5,238,013 A 8/1993 Battiston et al.
5,301,703 A 4/1994 Kahn
5,301,704 A 4/1994 Brown
5,307,828 A 5/1994 Gardner et al.
5,390,687 A 2/1995 Tsai
5,409,029 A 4/1995 Davis
5,485,862 A * 1/1996 Kahn ..... 135/77
5,713,382 A 2/1998 Midcap
5,785,070 A 7/1998 Block et al.
5,806,548 A 9/1998 Goldstein et al.
5,826,606 A 10/1998 Davenport
5,945,178 A * 8/1999 Volkmann ..... 428/11
6,138,699 A 10/2000 Su
6,378,540 B2 4/2002 Iwasa
6,877,520 B2 4/2005 Morris (Continued)

FOREIGN PATENT DOCUMENTS

JP 2000325119 A * 11/2000

(Continued)

*Primary Examiner*—Winnie Yip

(57) ABSTRACT

An Assistive Walking Device that provides added support to persons requiring a mobility aid. Three or more stiff or flexible spherical or partial spherical-shaped structures are attached to a support or frame structure that includes a handle or grip. The three or more spherical structures attached to the support structure or frame, absorb shock during the walking motion and grip the ground, thus improving walking stability. The three or more spherical or partial spherical-shaped structures can vary in size, composition, construction design, pattern arrangement and pliability characteristics, and the frame or support structure to which the spherical structures are attached is variable in design according to the specific application requirements of the person requiring the mobility aid.

18 Claims, 6 Drawing Sheets

U.S. PATENT DOCUMENTS

| | | | | |
|---|---|---|---|---|
| 7,047,990 | B2 | 5/2006 | Zambrano et al. | |
| D531,399 | S * | 11/2006 | Olerud | D3/7 |
| 7,234,199 | B2 * | 6/2007 | Bushey | 16/42 R |
| 7,234,200 | B2 * | 6/2007 | Chase | 16/42 R |
| 7,270,138 | B2 * | 9/2007 | Liao | 135/82 |
| 7,404,232 | B2 * | 7/2008 | Chase | 16/42 T |
| 2005/0205121 | A1 | 9/2005 | Lindgren | |
| 2006/0207045 | A1 * | 9/2006 | Pyka et al. | 15/209.1 |
| 2007/0102080 | A1 * | 5/2007 | Spangler | 150/154 |

FOREIGN PATENT DOCUMENTS

| | | | |
|---|---|---|---|
| JP | 2002065328 | A * | 3/2002 |
| JP | 2004290433 | A * | 10/2004 |
| JP | 2005006699 | A * | 1/2005 |
| JP | 2005176983 | A * | 7/2005 |

* cited by examiner

ASSISTIVE WALKING DEVICE WITH MULTIPLE SUPPORT SPHERES

CROSS REFERENCE TO RELATED APPLICATION

This application claims the benefit of Provisional Patent Application No. 60/763,112 filed Jan. 28, 2006.

THE BACKGROUND OF THE INVENTION

The Assistive Walking Device With Multiple Support Spheres provides added support to elderly and disabled persons when walking. Three or more hard or flexible rubber, plastic or composite spherical or partial spherical structures attached to a support structure that includes a handle or grip enables a person requiring a mobility aid to gain additional stability over present tripod and quad cane designs. The present invention consists of at least three spherical or partial spherical shaped structures that contact the ground while the user of the invention is walking and provides a stable assistive walking platform. The three or more spherical structures attached to the frame structure absorb shock and grip the ground surface during walking. At least three spherical shaped structures provide walking stability when the user applies pressure to the three or more spherical shaped structures in contact with the ground during walking motion. A downward pressure applied to the three or more spherical structures by the user results in a temporary gripping of the ground surface. The spherical surfaces of the three or more spherical shaped structures enable a natural rolling motion of the walking device when in use. The spherical shaped structures are removable from the frame or support structure, and different types of spherical and frame structures can be selected to meet the particular situation of the user. The removable spherical shaped structures can vary in size, number and pliability characteristics and the frame or support structure to which the spherical structures are attached is variable according to specific application requirements.

Prior Art

Existing assistive walking devices that utilize three or more legs consist of the quad cane design comprised of four tubular legs with rubber tips attached to the end of each leg and the tripod cane comprised of three tubular legs. The tubular legs of a quad cane are attached to a metal or plastic plate and a tubular extension with handle is attached to the metal plate. The tripod cane design utilizes three metal tubular legs with rubber feet attached to the ends of the tubular legs that are in turn attached to an extension tube and handle. The rubber feet of the quad cane and tripod cane designs contact the ground when the user of these devices walks. The basic design and function of both the tripod and quad canes has changed little over the years.

The Assistive Walking Device with Multiple Support Spheres takes a new approach to improving walking stability. The Assistive Walking Device with Multiple Support Spheres uses three or more spherical or partial spherical shaped structures that contact and grip the ground to improve stability during walking. When the three or more spherical shaped structures of the present invention are in simultaneous contact with the ground surface along with a downward pressure exerted on the spheres during walking, a gripping of the ground surface and support of the user takes place beyond what is possible with single tipped walking canes and existing tripod and quad cane devices.

SUMMARY OF THE INVENTION

It is the object of the present invention to provide a device that can increase the stability of elderly and disabled persons and prevent falls that can result in serious injury when walking on a variety of surfaces. In addition, it is the object of the present invention to accomplish the task of increasing walking stability by using three or more rubber, plastic or composite spherical shaped structures attached to a metal or plastic support frame or other assembly. The frame or assembly can be comprised of a tubular construction that is straight, curved or bent with a handle or grip included as part of the frame or assembly.

The present invention provides a lightweight device that can increase walking stability when used on a variety of surfaces such as smooth pavement or rough gravel. Variations of the Assistive Walking Device With Multiple Support Spheres can also be used to gain extra stability for sporting-related activities such as hiking and rollerblading. The number (three or more), size and flexibility of the spherical shaped structures are variable according to the specific requirements of the user. At least three spherical shaped structures are used with a support structure or frame device to provide support to the user when the spherical shaped structures contact the ground during walking. Furthermore, the pattern or arrangement of the spherical shaped structures is variable according to the requirements of the user.

BRIEF DESCRIPTION OF THE DRAWINGS

A more complete appreciation of the invention and many of the attendant advantages thereof will be readily obtained as the invention becomes better understood by reference to the following detailed description when considered in connection with the accompanying drawings; wherein.

DETAILED DESCRIPTION OF THE PREFERRED EMBODIMENTS

Figure 1:
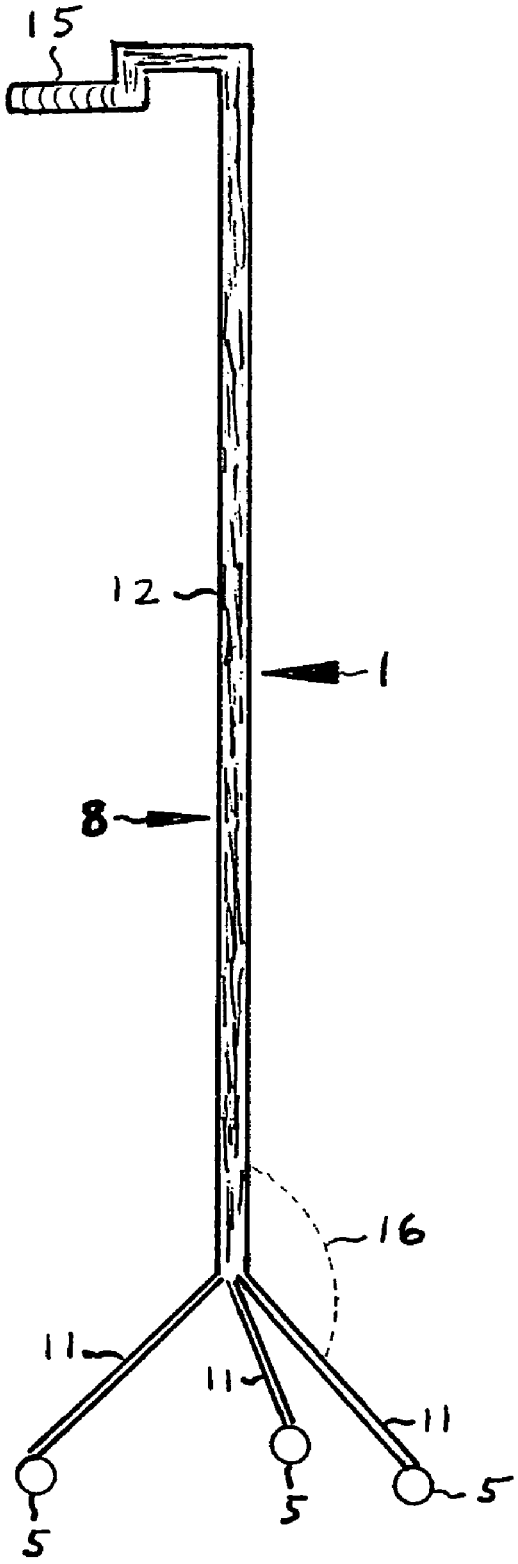
FIG. 1 is an overall view showing the external appearance of the preferred embodiment of the present invention entitled Assistive Walking Device with Multiple Support Spheres.

Reference will now be made in detail to the present preferred embodiments of the invention, examples of which are illustrated in the accompanying drawings, wherein like reference numerals in the text indicate like elements throughout the drawings.

The Assistive Walking Device With Multiple Support Spheres 1 illustrated in FIG. 1 consists of three or more spherical shaped structures 5 and a support structure 8 to support and hold the three or more spherical shaped structures 5. FIG. 1 includes an extension shaft 12 as part support structure 8. Preferably, one or more handles or grips 15 are attached to extension shaft 12. The design of the support structure 8 is variable according to the requirements of the application.

Figure 2A:
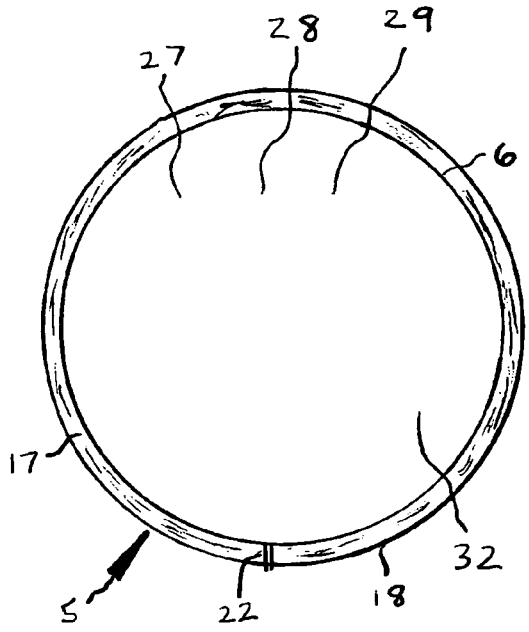
FIG. 2A is a cross section of a spherical shaped structure shown in FIG. 1 that includes a hard or flexible outer layer, shell or section along with a flexible inner core.

As illustrated in FIG. 2A, an embodiment of the spherical shaped structure 5 can consist of a rubber or plastic outer shell, layer or section 17 with a hollow inner space 6 pressurized with gas (including air) or a liquid to form a spherical shape. For example, as illustrated in FIG. 2A, the inner space 6 of a puncture-resistant outer shell, layer or section 17 comprised of polyurethane or another material can be pressurized with gas 27 to form flexible walking spherical shaped structure 5. The thickness of outer shell, layer, or section 17 is variable according to the desired assistive or sports-related walking application. The flexibility of outer layer, shell or section 17 is also variable according to the application, and can vary from flexible and soft to hard with little, if any, flexibility. Embodiments of spherical shaped structure 5 can also include inner space 6 without pressurization. The pressure of gas 27, or liquid 28, in interior space 6, can be adjusted to change the flexibility characteristics of sphere 5. As the pressure in interior space 6 increases, it can be expected that overall stiffness of the spherical shaped structure 5 will increase. Interior space 6 can also be filled with a gel material 29. The material composition of interior space 6 can be selected to meet the requirements of the assistive walking application. Interior space or core 6 can be comprised of other material compositions, including but not limited to a flexible plastic foam material 32. A valve 22 in outer shell, layer or section 17 is used to pump gas (including air), liquid, gel or a foam material into interior space 6. The material composition of outer shell, layer or section 17 can also be varied, adjusted or selected to change the flexibility characteristics of spherical shaped structure 5.

Figure 2B:
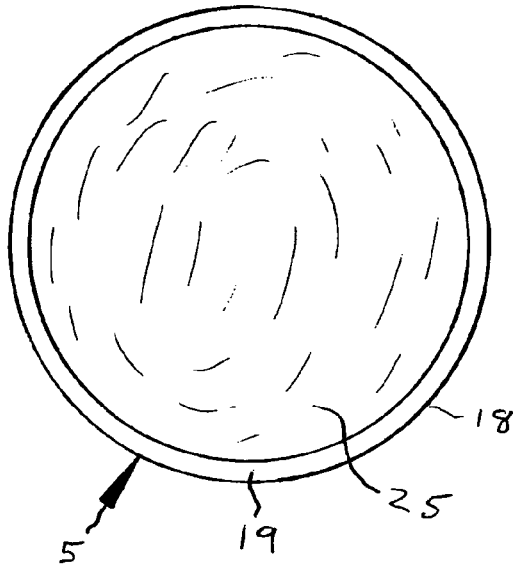
FIG. 2B is a cross section of a spherical shaped structure shown in FIG. 1 that includes a flexible outer layer, shell or section along with a hard inner core.

Spherical shaped structures 5 are fabricated of rubber, plastic, metal or composite material and can be either of a solid 14 design (see FIG. 3), or of a mixed construction as illustrated in FIGS. 2A and 2B. As illustrated in FIG. 2A, spherical shaped structure 5 may be comprised of a construction consisting of a flexible puncture resistant outer layer, shell or section 17 and a flexible inner core 6. Spherical shaped structure 5 can also consist, as illustrated in FIG. 2B, of a flexible outer layer, shell or section 19 and a hard inner core 25. The hard or stiff inner core 25 can be comprised of metal, plastic, rubber or a composite material. The flexible outer layer, shell or section 19 can be comprised of plastic, rubber, or a composite material. Both the pliability characteristics of outer layer, shell or section 17 or 19 and inner core 6 or 25 can be selected by the product designer to meet the needs of particular applications. Spherical shaped structures 5 can also consist of additional layers beyond the described outer layer, shell or segment 17 or 19 and inner core 6 or 25. That is, spherical shaped structures 5 can be comprised of several layers, if desired, and is not limited to two sections or layers. Materials for the spherical shaped structure 5 can be mixed in a single shaped structure 5 including one type of material for the interior core 6 and another type of material for the outer layer, shell or section 17. Outer contact surface 18 of spherical shaped structures 5 contacts the ground 40 during walking. The spherical shaped structure 5 can also consist of one type of material or composition throughout the entire spherical shaped structure 5. For a device application, the size, number and material construction of spherical shaped structures 5 are variable according to the particular requirements of the user. For example, a grouping of three or more small solid rubber spherical shaped structures 5 may be used for one mobility support application while a grouping of three or more larger air, liquid, gel or plastic foam-filled spherical shaped structures 5 may be used for another application. A particular application may also include mixing one or more solid spherical shaped structures 5 with one or more gas, gel, plastic foam or liquid-filled spherical shaped structures 5 in the same Assistive Walking Device With Multiple Support Spheres 1 to comprise the three or more spherical shaped structures 5 necessary to form an operational device 1. In addition, the spherical shaped structures 5 illustrated in FIG. 2A and FIG. 2B can be mixed, if desired. Spherical shaped structures 5 in a single embodiment of the present invention can be mixed to include a variety of material compositions as required by the application to achieve the best operational outcome. Additionally, the distance between spherical shaped structures 5 is variable enabling the pattern or arrangement and number of multiple spherical shaped structures 5 to be changed according to the requirements of the user application. For example, a grouping of three or more spherical shaped structures 5 can be close together and touching one another or spread apart from one another with space between each spherical shaped structure 5 in the pattern. The three or more spherical shaped structures 5 can be arranged in any pattern that provides stable walking support. Embodiments of the present invention can be constructed that enable the distance between spherical shaped structures 5 to be adjusted by the user according to the specific application or requirements. When the spherical shaped structures 5 are arranged to form a triangular, rectangular, or square pattern and all the spherical shaped structures 5 in the pattern are in contact with the ground during the walking motion, a stable platform is created that can support the weight of the walking person. Other patterns can also be applied including multiple spherical shaped structures 5 arranged in a circular pattern. FIG. 4 includes examples of some of the many arrangements of spherical shaped surfaces 5 that are possible with Walking Device 1. Many other pattern arrangements of spherical shaped structures 5 are also possible beyond those illustrated in FIG. 4A through FIG. 4J.

Figure 3:
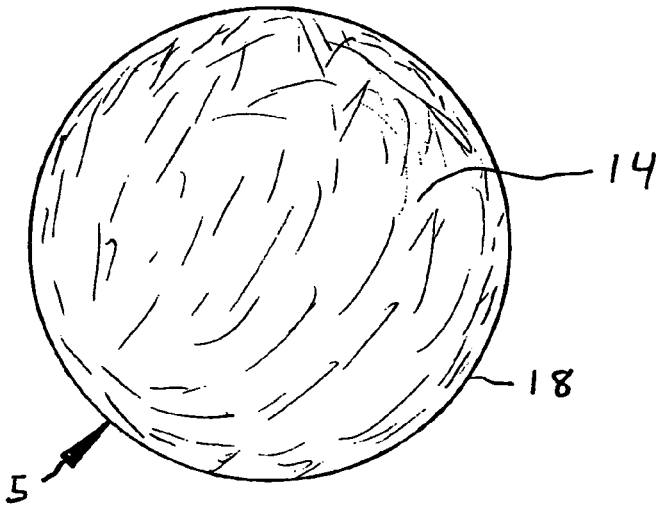
FIG. 3 is a cross section of a spherical shaped structure shown in FIG. 1, which consists of the same material construction throughout the sphere.
Figure 5A:
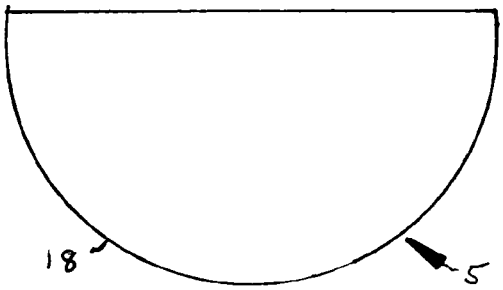
FIG. 5A and FIG. 5B consist of views of two of the many possible partial spherical shaped structures that can be used with the present invention.
Figure 5B:
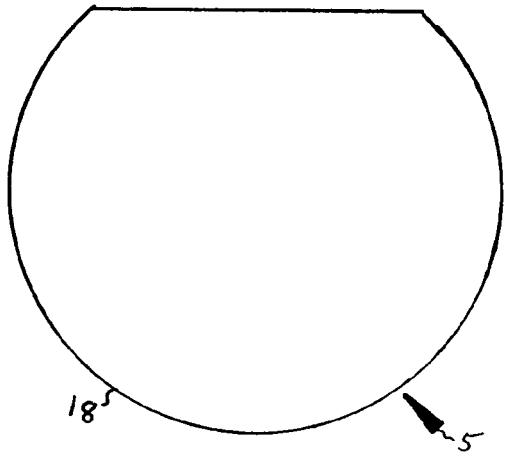
Figure 6A:
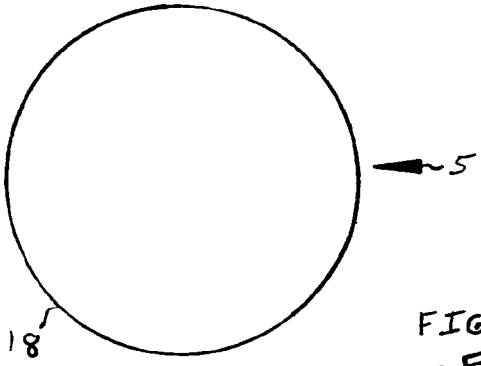
FIG. 6A-FIG. 6C are cross sections of some of the possible outer contact surfaces of the spherical shaped structures that can be used with the present invention, including, a smooth outer surface (6A), a surface that includes protrusions (6B), and a surface that includes a raised tread (6C).
Figure 6B:
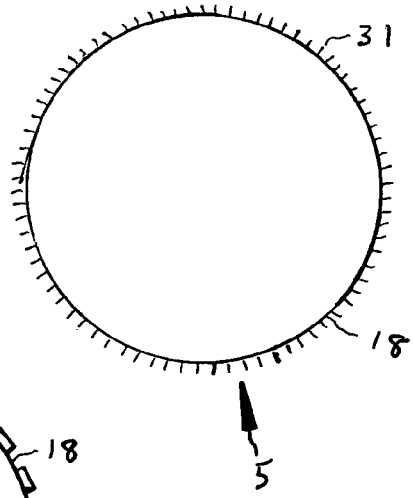
Figure 6C:
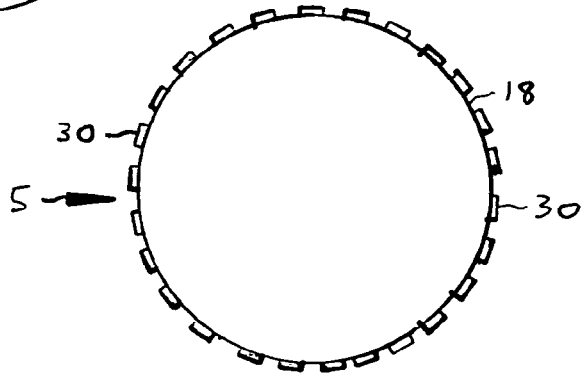

Spherical surface structure 5 besides being fabricated in the shape of a whole sphere can also be fabricated as a partial sphere as illustrated in FIG. 5A and FIG. 5B. The preferred embodiment uses whole spherical surfaces 5. The preferred embodiment also includes spherical shaped structures 5 that are pliable. Some examples of partial spherical shaped structures 5 include ½, ¾ or another fraction of a whole sphere. Partial spherical shaped structures can also consist of a cross section slice or segment of a whole spherical shaped structure. Other spherical shapes that can be used for spherical surface structure 5 include spheroids or ellipsoids or partial versions of these shapes. There may be occasions where a partial sphere 5 may be molded as part of or attached to another geometric shape fabricated of metal, plastic, rubber or composite material, such as a cube, to address specialized applications. As illustrated in FIG. 6A, the outer contact surface 18 of spherical shaped structure 5 can be smooth or as illustrated in FIG. 6C can be fabricated with a tread 30 or raised surface pattern. A sunken or raised tread 30, when included as part of contact surface 18 of outer layer, shell or section 17 of spherical shaped structure 5, contacts the ground 40 during walking and assists in gripping the surface, thus improving walking stability during wet or other slippery conditions. FIG. 3 illustrates a raised tread 30, but a tread pattern 30 can also be used that is sunken or indented into outer contact surface 18 of spherical shaped structure 5. Tread pattern 30 can be a depression in outer contact surface 18.

The size, hardness or flexibility of spherical shaped structures 5 is variable so that different application requirements can be addressed. For example, large flexible spheres 5 may be used for one application while another application may employ smaller and less flexible spheres 5. Different sized spherical shaped structures 5 can also be mixed together for a particular mobility support application. Spherical shaped structures 5, comprised of different material constructions and flexibility characteristics, can also be mixed together in a single device 1. For some sports related applications, the spherical shaped structures 5 may be hard with no or minimal flexibility characteristics. As illustrated in FIG. 6B, protrusions 31 can be included on the spherical outer surface of spherical shaped structures 5 such as metal pins to aid in trail walking or walking on ice. Other patterns or techniques suitable for gripping ice can also be used on outer contact surface 18 of outer shell, layer or section 17, including but not limited to, metal chains and blades. Indentations can also be included in the contact surface 18 of shell, layer or section 17 of spherical shaped structure 5. If spherical shaped structure 5 is fabricated from metal, the ice-gripping pattern on the outer contact surface 18 can be cast in the structure 5 at the time of manufacture. Metal spherical shaped structures 5 can be fabricated from lightweight metals such as aluminum, magnesium, titanium or a lightweight alloy. Metal spherical shaped structures 5, besides being solid, can be hollow to save weight. Metal spherical shaped structures 5 can also include an outside layer of rubber or plastic that is smooth or includes a tread pattern.

Figure 7:
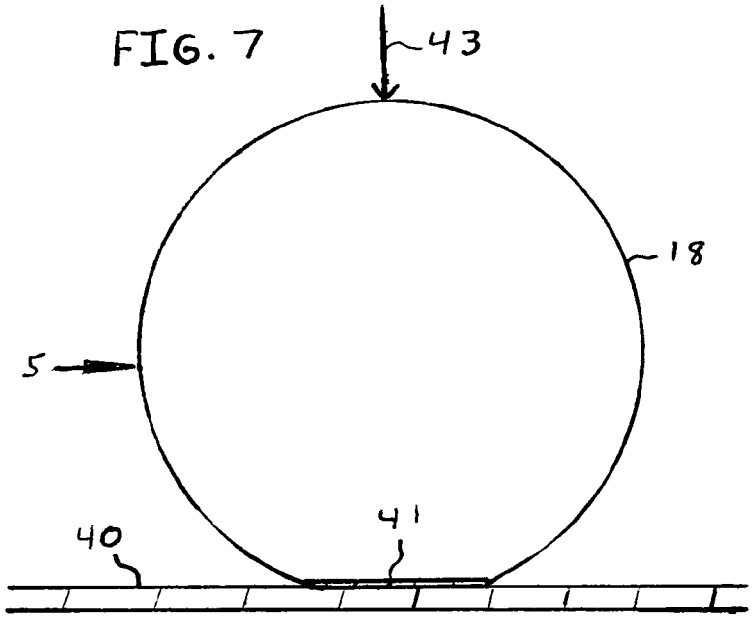
FIG. 7 is a cross section that illustrates how when a downward pressure is applied to a spherical shaped structure of the present invention that is flexible in construction, a portion or section of the outer contact surface of the spherical shaped structure flattens against the ground and grips the ground.

If the spherical shaped structures 5 are flexible in construction, a downward pressure 43 applied to the spherical structures 5 will cause outer contact surface 18 of the spherical shaped structures 5 in contact with the ground 40 to flatten 41 and grip the ground surface 40, thus increasing walking stability (see FIG. 7). The amount of flattening of spherical structure 5 outer contact surface 18 against the ground surface 40 is dependent on the flexibility of spherical shaped structure 5. Tread pattern 30 illustrated in FIG. 6 works in unison at the area 41 of sphere 5 that flattens against the ground 40 to improve gripping ability.

Spherical shaped structure 5, if of a solid construction, can be attached or connected to support structure 8 by screws or some other mechanical means. For example, a female or male screw tread can be molded into the spherical shaped structure 5 enabling easy removal and attachment to support structure 8. If the spherical shaped structure 5 includes an interior core 6, consisting of liquid 28, gas 27, gel 29, plastic foam 32 or some other flexible material, the sphere 5 can be molded with a sold piece or protrusion that enables attachment or connection to support structure 8 through the use of screws, pins, clamps or some other mechanical means. Adhesive means can also be used as a means of attaching or fastening the spherical shaped structures 5 to support structure 8. For example, flexible rubber or plastic spherical shaped structures 5 can be attached to support structure 8 through the application of adhesives or another means if a mobility application is determined to require spherical shaped structures 5 with a high degree of flexibility. Heat or chemical welding techniques can also be used where appropriate to attach spherical shaped structures 5 to support structure 8. Spherical shaped structures 5 can also be attached or connected to support structure 8 by enabling a protrusion on frame 8 to fit into a socket fabricated as part of spherical shaped structure 5. The protrusion on support structure 8 is pushed into the socket of spherical shaped structure 5 to facilitate attachment to support structure 8. Likewise, a protrusion molded as part of the spherical surface structure 5 can fit into a socket on frame 8. Spherical shaped structures 5 can also be fabricated with a twist lock mechanism or screw pattern that enables easy attachment to and removal from support structure 8. Other means of attaching spherical shaped structures 5 to support structure 8 are available beyond the methods presently described. Spherical shaped structures 5, when attached to support structure 8, can either be stiff with no movement at the point of attachment to support structure 8 or the point of attachment of spherical shaped structure 5 to support structure 8 can enable movement of the spherical surface structures 5 in one or more directions at the point of attachment to support structure 8. That is, the spherical shaped structures 5 can be enabled to rotate in one or more directions on support structure 8 or other embodiments can be stiff with no rotation capability.

Support structure 8, which the spherical surface structures 5 are attached to, can be fabricated from a wide-variety of materials including, plastic, metal, rubber, wood or a composite such as graphite-reinforced epoxy and can include plates, tubes or extension legs in the construction. Other composite or material combinations can also be used beyond graphite-reinforced epoxy to construct support structure 8. As illustrated in FIG. 1, the support structure 8 can be as simple as a pole or extension 12 with a handle or grip 15 at one end of the pole or extension 12 and three or more spherical walking structures 5 at the other end of the pole or extension 12. The support structure 8 is not limited to the use of extension legs 11 as the point of attachment of the spherical shaped structures 5, and can include arrangements where the spherical shaped structures 5 are connected to other types of physical support structures 8 such as a plate shaped structure or can include the use of tubular shaped structures beyond the straight extension legs 11 illustrated in FIG. 1. Other support structure 8 variations may include more complex designs. The design of support structure 8 is variable in design according to the specific walking application and need of the user. As long as the user can comfortably grip and hold the spherical walking device 1 and the three or more spherical shaped surfaces 5 contact the ground 40 at some point during the walking motion, any type of design can be used as the support structure 8 in the present invention. Ground 40, in the present invention, is defined to mean any surface that a person can walk on. Support structure 8 can be vertical in relationship to the ground or can be horizontal in relationship to the ground with multiple spherical surface structures 5 attached to support structure 8. The Support structure 8 to which spherical surface structures 5 are attached may be stiff or flexible and may be straight like a pole or may include angles, bends, or curves in the construction design. Furthermore, support structure 8 may be adjustable for length and spread angle at any point at or on support structure 8. For example, if a support structure 8 includes extension legs 11 to hold and support the spherical walking surfaces 5, the angle and/or length of the extension legs 11 can be adjusted in relationship to the ground to meet the requirements of different users. For example, the angle 16 of extension tubes 11 in relationship to pole or extension 12 can be adjusted to meet the application of different sized spherical shaped structures 5. The Spherical shaped structures 5 can be removed from support structure 8 and replaced with new ones 5 as they wear out.

Figure 8A:
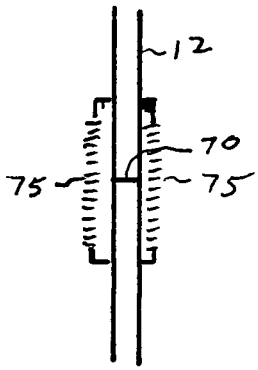
FIG. 8A, FIG. 8B, and FIG. 8C illustrate a joint and spring mechanism that can be applied in embodiments where the joint enables a bending of the shaft or pole shown in FIG. 1 to take place when the user of the present invention applies a downward pressure while walking, and the tension from the springs result in the shaft automatically straightening when the downward pressure on the present invention is relieved.
Figure 8B:
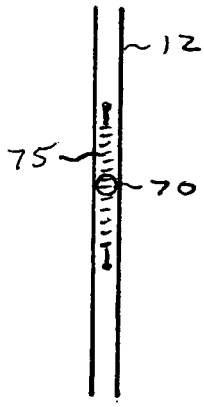
Figure 8C:
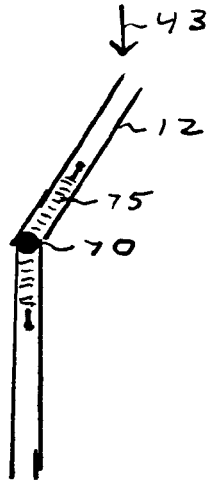

An embodiment of the support structure 8, as illustrated in FIG. 8A, FIG. 8B, and FIG. 8C, can include a pivot or joint 70 located in or between segments of support frame 8 that includes springs 75 to straighten out the bend at the pivot or joint that occurs when downward pressure 43 is applied by the user on the support frame 8 during the walking motion. The pivot or joint 70 is located between two segments of support structure 8 as illustrated in FIG. 8A, FIG. 8B, and FIG. 8C enabling the two segments of support structure 8 at the joint or pivot 70 to bend when pressure 43 is applied and straighten out when pressure 43 is taken off the joint 70. The springs 75 return the pivot or joint 70 and associated segments of support structure 8 to a straightened position when downward pressure 43 is relieved from the joint 70 and the associated segments of the support structure 8. The support structure 8, in this embodiment that includes the joint and spring mechanism (70 and 75) may consist of a simple single tubular structure as illustrated in FIG. 8A, FIG. 8B, and FIG. 8C such as the pole or extension 12 illustrated in FIG. 1. The springs 75 automatically straighten the support structure 8 at the pivot or joint 70 as illustrated in FIG. 8B after bending takes place at the pivot or joint 70 during the walking motion as illustrated in FIG. 8C. The spring-operated pivot or joint 70 in the support structure 8 enables the three or more spherical shaped structures 5 to remain in simultaneous contact with the ground 40 for a longer time period during the walking motion. Other embodiments are possible that include joint and spring mechanism (70 and 75) beyond the embodiment described. There may also be occasions where it is beneficial to include more than one spring and joint mechanism (70 and 75) in a single device 1.

Figure 9:
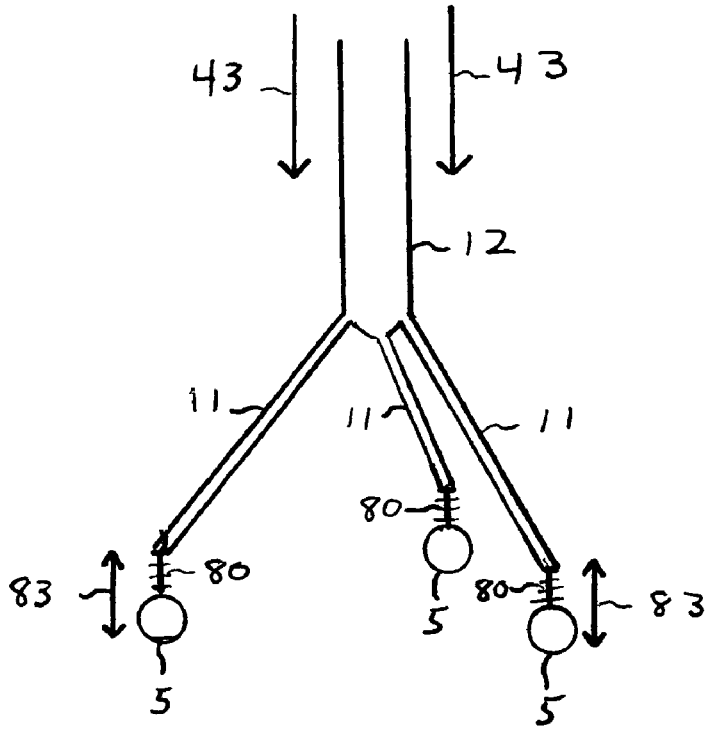
FIG. 9 illustrates a spring mechanism that can be used with the spherical shaped structures of the present invention to absorb shock and enable the multiple spheres to adjust to uneven ground surfaces when walking.

The Assistive Walking Device With Multiple Support Spheres 1 can also include a spring 80 that moves in a linear motion enabling the spherical shaped structures 5 attached to support structure 8 to adjust to a variety of surfaces and absorb shock. As illustrated in FIG. 9, each spherical shaped structure 5 attached to support structure 8 has its own spring assembly 80 that moves in a downward linear motion 83 when pressure 43 is applied by the user downward on the spherical shaped structures 5 and when pressure 43 is released, the spring 80 returns in an upward linear motion 83. The linear motion spring assembly 80 is located above the spherical shaped structures 5 or springs 80 can also be located in the spherical shaped structure 5 itself. One or more spherical shaped structures 5 that include a linear spring shock absorbing mechanism 80 can also be used in a configuration, if desired, with one or more spherical shaped structures 5 that does not include linear spring 80 mechanisms. That is, not all of the spherical shaped structures 5 in a grouping of three or more structures 5 is required to include a linear spring mechanism 80. A spring shock absorbing mechanism can also be located in shaft or pole 12 or in extension legs 11 of support structure 8. Likewise, in other embodiments of the present invention, a spring shock absorbing mechanism can be located anywhere in support structure 8 to absorb shock during the walking motion. The embodiment that includes springs 75 and joint or pivot 70 as illustrated in FIG. 8A, FIG. 8B, and FIG. 8C can be combined with the application of the linear shock absorbing and terrain leveling mechanism 80 illustrated in FIG. 9 in a single embodiment of the present invention.

Figure 10:
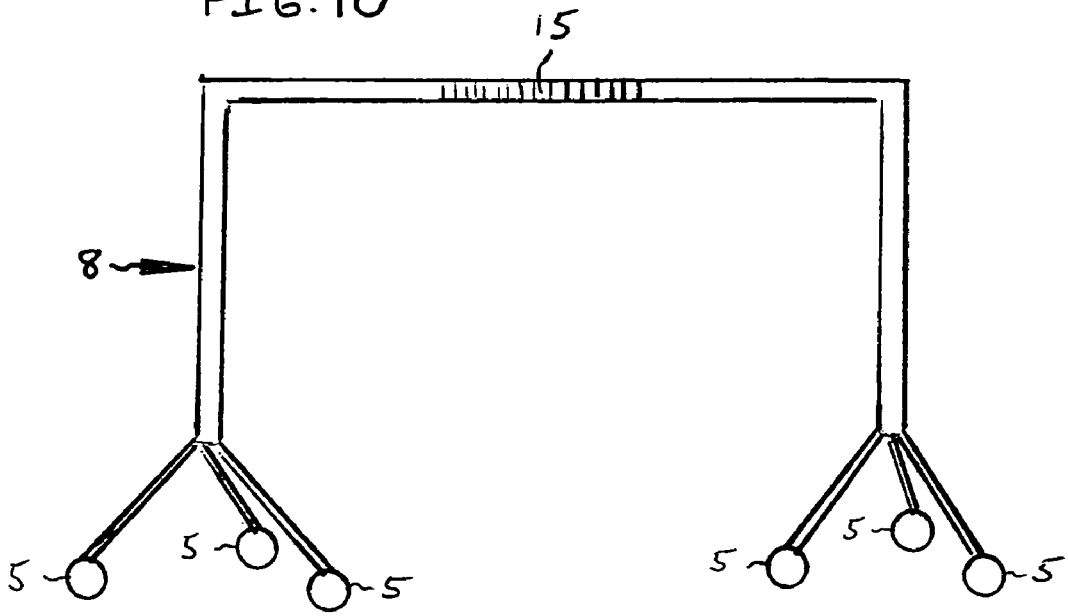
FIG. 10 illustrates an embodiment of the present invention that includes two groups of multiple spherical shaped structures to improve stability.

The distance between spherical surface structures 5, the number of spherical shaped structures 5 and the type of support structure 8 are variable and can be changed to meet different requirements. One or more spherical surface structures 5 can be attached to each extension piece 11 of a support structure 8. Also, besides applying a single group of three or more spherical surface structures 5 attached to a support structure 8 to aid in walking, more than one grouping of three or more spherical surface structure 5 can be attached to two or more locations of a support structure 8. For example as illustrated in FIG. 10, a group of three or more spherical shaped structures 5 can be attached at location A and another grouping of three or more spherical shaped structures 5 can be attached at location B of the same support structure 8 to form an Assistive Walking Device 1. Multiple groups of three or more spherical shaped structures 5 attached to the same support structure 8 can create lightweight Assistive Walking Devices With Multiple Support Spheres 1 that have increased stability over single group spherical shaped structure 5 designs.

Figure 4A:
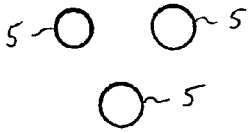
FIG. 4A-FIG. 4J are bottom views of the many possible arrangements of spherical shaped structures that can contact the ground when a user of the present invention is walking.
Figure 4B:
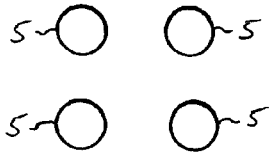
Figure 4C:
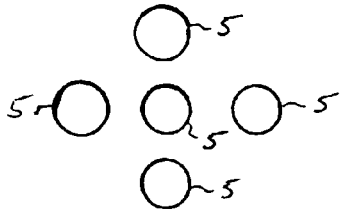
Figure 4D:
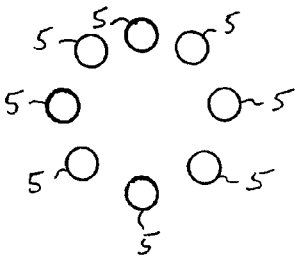
Figure 4E:
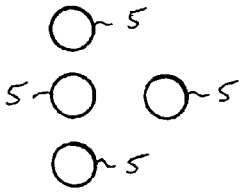
Figure 4F:
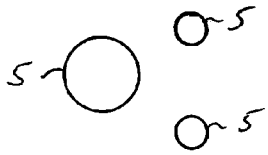
Figure 4G:
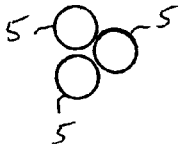
Figure 4H:
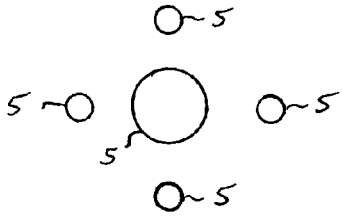
Figure 4I:
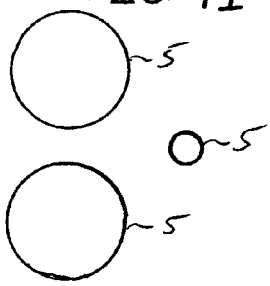
Figure 4J:
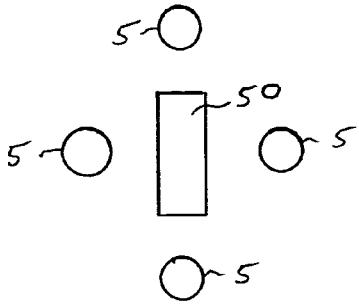

The Assistive Walking Device With Multiple Support Spheres 1 can consist of a large spherical surface 5 that includes smaller spherical shaped structures 5 positioned near the larger spherical shaped structures 5 as illustrated in FIG. 4F, FIG. 4H, and FIG. 4I. Other arrangements are possible beyond the embodiments illustrated in FIG. 4F, FIG. 4H, and FIG. 4I. For some applications, as illustrated in FIG. 4J, a flat surface 50 that contacts the ground can be combined with three or more spherical shaped structures 5 that are positioned near flat surface 50. Other arrangements are possible beyond the embodiment illustrated in FIG. 4J. Flat surface 50 can be fabricated from hard or soft materials including, metal, plastic, rubber, wood or a composite mixture. Both flat surface 50 and the three or more spherical shaped structures 5 contact the ground 40 during the walking motion. Flat surface 50, which contact the ground, can include a tread pattern 30 or other means to improve traction. The large spherical shaped structures 5 or the flat surface 50 can be flexible or non-flexible. The number of spherical shaped support structures 5 that can be used in proximity to flat surface 50 can be more than three. The distance between the spherical shaped structures 5 and flat surface 50 is variable according to the application. The flat surface 50 can be fabricated in a variety of shapes or patterns. Flat surface 50 can also include the use of a spring shock absorbing and terrain leveling mechanism 80. FIG. 4J illustrates flat surface 50 with spherical shaped structures 5 located in proximity to the flat surface 50 arranged around the flat surface 50.

The Assistive Walking Device With Multiple Support Spheres 1 operates with the user holding handle or grip 15. As the user walks, spherical shaped structures 5 alternately are raised and lowered on an off the ground 40. The preferred means of use with the present invention is for the user to lift the spherical shaped structures 5 off the ground 40 using associated support structure 8 and then place the spherical shaped structures 5 on the ground 40 in repeatable fashion with each step. As the user walks, downward pressure 43 exerted on the support structure 8 of the Walking Device 1 results in the surface of the spherical shaped structures 5 contacting and gripping the ground 40 as pressure 43 by the user presses the spherical surface structures 5 against the ground 40 while walking. The spherical shape of the spherical surface structures 5 enables the user of the Walking Device 1 to move the spheres 5 on the ground 40 in a natural motion so that the surface area 18 of the spheres 5 stay in contact with the ground 40 during part or most of the walking motion, thus improving walking support and stability.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A walking device;

comprised of:

three or more spherical, ellipsoidal, spheroidal, or partial spherical, spheroidal, or ellipsoidal shaped structures attached or connected to a support structure operable for being hand held or gripped by a person;

Whereby, the said three or more spherical, ellipsoidal, or spheroidal, or partial spherical, spheroidal, or ellipsoidal shaped structures attached or connected to said support structure, contact the ground surface when said person holding said support structure of said walking device is walking, and whereby, the surface of at least one of the said three or more spherical, spheroidal, or ellipsoidal, or partial spherical, spheroidal, or ellipsoidal shaped structures attached or connected to said support structure includes depressions, notches, cuts, grooves, protrusions, indentations, a tread or a raised or sunken pattern.

2. A walking device as recited in claim 1, wherein the said three or more spherical, ellipsoidal, or spheroidal or partial spherical, spheroidal, or ellipsoidal shaped structures attached or connected to said support structure are flexible.

3. A walking device as recited in claim 1, wherein the size, material composition, number, pliability, or pattern arrangement of the said three or more spherical, spheroidal, or ellipsoidal, or partial spherical, spheroidal, or ellipsoidal shaped structures attached or connected to said support structure can be selected before, during, or after manufacture to address different walking applications.

4. A walking device as recited in claim 1, wherein the measurable distance between each of the said three or more spherical, ellipsoidal, or spheroidal or partial spherical, spheroidal, or ellipsoidal shaped structures attached or connected to said support structure is adjustable.

5. A walking device as recited in claim 1, whereby, a said spherical, spheroidal, or ellipsoidal or partial spherical, spheroidal, or ellipsoidal shaped structure attached or connected to said support structure can be of the same material composition throughout the said spherical, spheroidal, or ellipsoidal or partial spherical, spheroidal, or ellipsoidal shaped structure and can be either flexible or stiff; whereby, a said spherical, ellipsoidal, or spheroidal, or partial spherical, spheroidal, or ellipsoidal shaped structure attached or connected to said support structure can consist of a layered construction; whereby, a said spherical, ellipsoidal, or spheroidal or partial spherical, spheroidal, or ellipsoidal shaped structure attached or connected to said support structure can include a space or section that contains a gas, gel, liquid, plastic foam or some other flexible material; whereby, a said spherical, ellipsoidal, or spheroidal or partial spherical, spheroidal, or ellipsoidal shaped structure attached or connected to said support structure can include a flexible or stiff outer section or layer and a flexible or stiff inner section or layer; or whereby, a said spherical, ellipsoidal, or spheroidal or partial spherical, spheroidal, or ellipsoidal shaped structure attached or connected to said support structure can include a hollow space.

6. A walking device as recited in claim 1, whereby said support structure that the said three or more spherical, spheroidal, ellipsoidal, or partial spherical, spheroidal, or ellipsoidal shaped structures are attached or connected to is variable in regards to material composition, may be stiff or flexible, and may be straight like a pole or include angles, bends, curves, plates, tubes or extension legs in the construction.

7. The walking device as recited in claim 1, wherein at least one spring mechanism is included in or located above one or more of the said three or more spherical, spheroidal, or ellipsoidal, or partial spherical, spheroidal, or ellipsoidal shaped structures attached or connected to said support structure, enabling the said spherical, spheroidal, or ellipsoidal, or partial spherical, spheroidal, or ellipsoidal shaped structure that has the spring mechanism positioned in or above it to move in a linear motion, thus enabling said walking device to adjust to a variety of ground surfaces and to absorb shock.

8. The walking device as recited in claim 1, whereby the said three or more spherical, spheroidal, or ellipsoidal, or partial spherical, spheroidal, or ellipsoidal shaped structures are removable from said support structure.

9. The walking device as recited in claim 1, whereby one or more pivots or joints are located in or between said support structure enabling said support structure to bend at said one or more pivots or joints when a downward pressure is applied to said support structure and associated one or more pivots or joints and that includes at least one spring mechanism associated with each of the said one or more pivots and joints located in or between said support structure operable for straightening said support structure when downward pressure is relieved from said support structure and associated one or more pivots or joints.

10. The walking device as recited in claim 1, whereby the said three or more spherical, spheroidal, or ellipsoidal, or partial spherical, spheroidal, or ellipsoidal shaped structures attached to said support structure are removable from said support structure.

11. The walking device as recited in claim 1, whereby the pliability characteristics of each of the said three or more spherical, ellipsoidal, or spheroidal or partial spherical, spheroidal, or ellipsoidal shaped structures attached or connected to said support structure is variable.

12. The walking device as recited in claim 1, whereby the interior of the three or more spherical, ellipsoidal, or spheroidal or partial spherical, spheroidal, or ellipsoidal shaped structures attached or connected to said support structure can contain a gas, liquid, gel, foam or some other material composition.

13. The walking device as recited in claim 1, wherein the three or more spherical, ellipsoidal, or spheroidal or partial spherical, spheroidal, or ellipsoidal shaped structures attached or connected to said support structure can be comprised of two or more separate groups of three or more spherical, spheroidal, ellipsoidal, or partial spherical, spheroidal, or ellipsoidal shaped structures attached to said support structure.

14. A walking device;

comprised of:

three or more flexible spherical, spheroidal, or ellipsoidal, or partial spherical, ellipsoidal, or spheroidal shaped structures attached or connected to a support structure operable for being hand held or gripped by a person;

whereby, the said three or more spherical, spheroidal, or ellipsoidal, or partial spherical, spheroidal, or ellipsoidal shaped structures attached or connected to said support structure, contact the ground surface when said person holding said walking device support structure is walking, and whereby, the surfaces of the said three or more spherical, spheroidal, or ellipsoidal, or partial spherical, spheroidal, or ellipsoidal shaped structures attached or connected to said support structure include protrusions, indentations, notches, cuts, grooves, depressions, a tread, or a sunken or raised pattern.

15. A walking device as recited in claim 14, whereby the measurable distance between each of the said three or more spherical, ellipsoidal, or spheroidal or partial spherical, spheroidal, or ellipsoidal shaped structures attached or connected to said support structure is adjustable.

16. A walking device as recited in claim 14, whereby the size, material composition, number, pliability, material composition and pattern arrangement of the said three or more flexible spherical, spheroidal, or ellipsoidal, or partial spherical, spheroidal, or ellipsoidal shaped structures attached or connected to said support structure can be selected to meet the requirements of the walking application.

17. A walking device as recited in claim 14, whereby, a said flexible spherical, spheroidal, or ellipsoidal or partial spherical, spheroidal, or ellipsoidal shaped structure attached or connected to said support structure can be of the same material composition throughout the said flexible spherical, spheroidal, or ellipsoidal or partial spherical, spheroidal, or ellipsoidal shaped structure; whereby, a said flexible spherical, ellipsoidal or spheroidal or partial spherical, spheroidal, or ellipsoidal shaped structure attached or connected to said support structure can consist of a layered construction; whereby, a said flexible spherical, ellipsoidal, or spheroidal or partial spherical, spheroidal, or ellipsoidal shaped structure attached or connected to said support structure can include a space or section that contains a gas, gel, liquid, plastic foam or some other flexible material; or whereby, a said flexible spherical, ellipsoidal, or spheroidal or partial spherical, spheroidal, or ellipsoidal shaped structure attached or connected to said support structure can include a hollow space.

18. A walking device as recited in claim 14, whereby said support structure that the said three or more flexible spherical, spheroidal, or ellipsoidal, or partial spherical, spheroidal, or ellipsoidal shaped structures are attached or connected to is variable in regards to material composition, may be adjustable, may be stiff or flexible, may be straight like a pole, or may include angles, bends, curves, plates, tubes or extension legs in the construction.

* * * * *